US007267247B1

(12) United States Patent
Crunkleton, III et al.

(10) Patent No.: US 7,267,247 B1
(45) Date of Patent: Sep. 11, 2007

(54) PORTABLE BEVERAGE DISPENSING SYSTEM

(76) Inventors: James T. Crunkleton, III, 7921 Smith Pond Dr., Denver, NC (US) 28037; David W. Dupree, 18219 Town Harbor, Cornelius, NC (US) 28031

( * ) Notice: Subject to any disclaimer, the term of this patent is extended or adjusted under 35 U.S.C. 154(b) by 259 days.

(21) Appl. No.: 10/671,015

(22) Filed: Sep. 25, 2003

(51) Int. Cl.
*B67D 5/56* (2006.01)
*B67D 5/60* (2006.01)
*B67D 5/62* (2006.01)

(52) U.S. Cl. ..... 222/5; 222/129.1; 222/145.5; 222/146.6

(58) Field of Classification Search ..... 222/5, 222/129.1, 145.5, 145.6, 146.6, 129.2, 129.3, 222/129.4; 261/DIG. 7
See application file for complete search history.

(56) References Cited

U.S. PATENT DOCUMENTS

| | | | | |
|---|---|---|---|---|
| 3,394,847 | A | 7/1968 | Garrard | 222/56 |
| 3,613,793 | A | 10/1971 | Huthsing, Jr. | 169/26 |
| 3,754,602 | A | 8/1973 | Magdars | 169/2 A |
| 4,093,681 | A | 6/1978 | Castillo et al. | 261/122 |
| 4,139,123 | A | 2/1979 | Castillo | 222/56 |
| 4,271,097 | A | 6/1981 | Garrard | 261/64 D |
| 4,313,897 | A | 2/1982 | Garrard | 261/64 D |
| 5,022,565 | A * | 6/1991 | Sturman et al. | 222/396 |
| 5,082,143 | A * | 1/1992 | Schramm, Jr. | 222/66 |
| 5,280,711 | A | 1/1994 | Motta et al. | 62/177 |
| 5,411,179 | A | 5/1995 | Oyler et al. | 222/129.1 |
| 5,553,749 | A | 9/1996 | Oyler et al. | 222/129.1 |
| 5,842,600 | A * | 12/1998 | Singleterry et al. | 222/1 |
| 6,021,922 | A | 2/2000 | Bilskie et al. | 222/67 |
| 6,036,054 | A * | 3/2000 | Grill | 222/3 |
| 6,234,349 | B1 | 5/2001 | Bilskie et al. | 222/67 |
| 6,253,960 | B1 | 7/2001 | Bilskie et al. | 222/67 |
| 6,712,342 | B2 * | 3/2004 | Bosko | 261/127 |
| 6,848,600 | B1 * | 2/2005 | Crisp, III | 222/129.1 |
| 2001/0013522 | A1 * | 8/2001 | McCann et al. | 222/61 |

OTHER PUBLICATIONS

Casino Beverage Serving Cart, Sterling Beverage Systems, Inc.; available as of filing date.
Casino/Hospitality "BevCart," Sterling Beverage Systems, Inc.; available as of filing date.
KegMan Beer Tap Products, Division of Crossfire Engineering Inc.; available as of filing date.
Motorless Carbonators and Seltzer Makers, Divison of Crossfire Engineering Inc.; available as of filing date.
Carbonators, Bevcore Solutions; available as of filing date.
Aluminum Carbon Dioxide Cylinders; available as of filing date.
In-flight beverage cart, Sterling Beverage Systems Inc.; Airline Industry News Roundup; Apr. 4, 2001.

* cited by examiner

*Primary Examiner*—Joseph A Kaufman
(74) *Attorney, Agent, or Firm*—Womble Carlyle Sandridge & Rice, PLLC

(57) ABSTRACT

A portable beverage dispensing system includes a supply of flat water and a supply of pressurized gaseous carbon dioxide. A first motorless carbonator is configured to receive a portion of the flat water and a portion of the carbon dioxide and to cause a portion of the carbon dioxide to dissolve in the flat water to produce partially carbonated soda. A second motorless carbonator is configured to receive a portion of the partially carbonated soda and a portion of the carbon dioxide and to cause a portion of the carbon dioxide to dissolve in the partially carbonated soda and to produce fully carbonated soda. The system also includes a dispenser for selectively dispensing the fully carbonated soda.

56 Claims, 17 Drawing Sheets

PORTABLE BEVERAGE DISPENSING SYSTEM

TECHNICAL FIELD

The invention generally relates to post-mix beverage dispensing systems, and more particularly relates to a compact and portable post-mix beverage dispensing system suitable for use on airplanes, railcars, or other applications where space and/or facilities are limited.

BACKGROUND

Post-mix beverage dispensing systems provide a convenient and efficient means for dispensing carbonated beverages to consumers. Such systems produce carbonated water, and mix flavored syrups with the carbonated water in desired ratios at a dispensing head or bar gun. Where such systems can be used, post-mixed beverages are highly cost-effective compared to more expensive pre-packaged carbonated beverages such as canned or bottled soft drinks.

Presently, commercial airlines typically serve prepackaged beverages to their passengers. Prepackaged beverages such as canned beverages are stored at room temperature in a portable cart that is sufficiently narrow to pass down the aisles of most commercial aircraft. As passengers request carbonated beverages, flight attendants remove the selected canned beverages from the portable cart, and pour the beverages over ice in a glass or cup. This process is time-consuming, and can be difficult or impossible under turbulent flight conditions. On short flights, at least some passengers often are unable to obtain a beverage due to the time required to dispense canned beverages to previously served passengers. In addition, the cost per serving of canned beverages is considerably higher than the cost per serving cost post-mixed carbonated beverages. Serving prepackaged beverages also generates considerable waste such as empty beverage cans that must be handled, temporarily stored, and discarded. In addition, pre-packaged carbonated beverages have a limited shelf life.

The challenges associated with producing compact and portable post-mix beverage dispensing systems are numerous. Such systems must operate without external sources of water and electric power. In addition, such systems must be sufficiently compact to permit their use in limited spaces such as the narrow confines of airplanes. Because such systems necessarily include stored high pressure carbon dioxide gas, the systems also must comply with stringent government safety regulations governing the packaging and transportation of high pressure gas containers. Furthermore, the makers of the most popular carbonated beverages (e.g. Coke ® and Pepsi ®, require their products to be consistently dispensed according to exacting product standards. One such requirement is that the dispensed beverages have a commercially acceptable level of carbonation of about 3 percent to about 4 percent.

Others have attempted to produce compact and portable post-mix beverage dispensing systems with limited success. For example, U.S. Pat. Nos. 5,411,179 and 5,553,749 to Oyler et al. describe self-contained beverage dispensing systems that use a single low-pressure motorless carbonator to carbonate flat water to produce soda for use in post-mixing and dispensing carbonated beverages. Unfortunately, such low-pressure motorless carbonators produce soda having only about 2.5 percent carbonation, which is well below a commercially acceptable level of carbonation and/or product standards dictated by makers of Coke ® and Pepsi®.

Others have tried to address this problem by developing portable beverage dispensers that include a single high-pressure motorless carbonator. The term "high pressure motorless carbonator" as used herein refers to a motorless carbonator that operates at an internal pressure of at least about 100 psi. For example, U.S. Pat. No. 6,021,922, U.S. Pat No. 6,234,349, and U.S. Pat. No. 6,253,960 to Bilskie et al. describe self-contained high-pressure beverage dispensing systems that include a single motorless carbonator that operates at a gas pressure of between 90-110 psi. Unfortunately, these systems also do not provide a highly portable and compact beverage dispensing system that produces soda that consistently meets commercially acceptable levels of carbonation and complies with applicable federal safety regulations for use on commercial aircraft.

Accordingly, there is a need for an effective, compact, and highly portable beverage dispensing system that operates without external sources of water and electric power. In addition, there is a need for such a system that is sufficiently compact to permit its use in limited spaces such as the narrow aisles of airplanes and passenger railcars. Such a system also must comply with applicable government safety regulations, and must consistently supply a commercially acceptable level of carbonation.

SUMMARY

A portable beverage dispensing system includes a supply of flat water and a supply of pressurized gaseous carbon dioxide. A first motorless carbonator is configured to receive a portion of the flat water and a portion of the carbon dioxide and to cause a portion of the carbon dioxide to dissolve in the flat water to produce partially carbonated soda. A second motorless carbonator is configured to receive a portion of the partially carbonated soda and a portion of the carbon dioxide and to cause a portion of the carbon dioxide to dissolve in the partially carbonated soda and to produce fully carbonated soda. The system also includes a dispenser for selectively dispensing the fully carbonated soda.

A portable beverage dispensing module includes a housing and a cylinder in the housing containing pressurized carbon dioxide. A first motorless carbonator is located in the housing, and is configured to receive flat water from a flat water supply and to receive a portion of the carbon dioxide. The first carbonator causes a portion of the carbon dioxide to dissolve in the flat water to produce partially carbonated soda. A second motorless carbonator is also located in the housing. The second carbonator is configured to receive the partially carbonated soda and a portion of the carbon dioxide, to cause a portion of the carbon dioxide to dissolve in the partially carbonated soda, and to produce fully carbonated soda. At least one pneumatic pump powered by the pressurized carbon dioxide is configured to pump flat water from the flat water supply to the first carbonator. The module further includes a dispenser for selectively dispensing the fully carbonated soda.

A high pressure gas cylinder for a portable beverage dispensing system includes a neck having a throat. A piercable membrane seals the throat of the cylinder. The term "high pressure gas cylinder" as used herein refers to cylinder that is capable of safely storing compressed gas at a pressure of at least about 1800 psi.

A two-stage motorless carbonator includes a first carbonation chamber having a flat water inlet, a first carbon dioxide inlet, and a first soda outlet. A second carbonation chamber includes a soda inlet, a second carbon dioxide inlet, and a second soda outlet. A conduit connects the first soda outlet of the first carbonation chamber to the soda inlet of the second carbonation chamber. Partially carbonated soda from the first carbonation chamber is passed to the second carbonation chamber through the conduit and is further carbonated in the second carbonation chamber.

DETAILED DESCRIPTION

Figure 1:
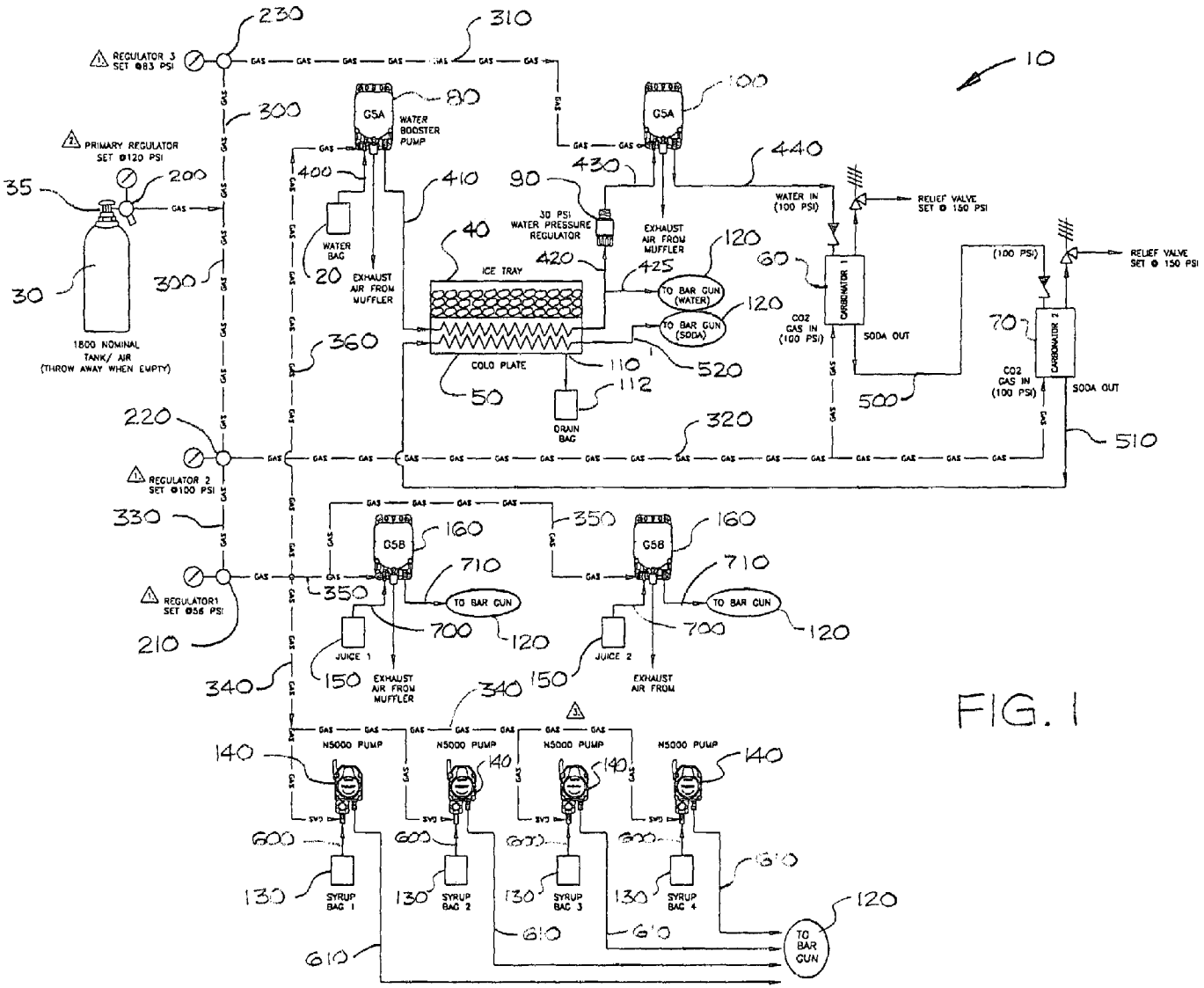
FIG. 1 is a schematic view of an embodiment of a beverage dispensing system according to the invention.

A schematic view of an embodiment of a compact and portable beverage dispensing system 10 according to the invention is shown in FIG. 1. The system includes a source of compressed carbon dioxide ($CO_2$) gas 30, a flat water reservoir 20, a cold plate 50 with an ice tray 40, a water pressure regulator 90, a first motorless carbonator 60, a second motorless carbonator 70, and a plurality of carbonated beverage flavorant supply reservoirs 130, and a plurality of non-carbonated beverage supply reservoirs 150. The system is capable of carbonating flat water to between about 3.6 percent and about 4.2 percent $CO_2$ by weight without electricity or an external pressurized water supply.

The system provides two sequential stages of carbonation. Flat water is first carbonated to between about 2.4 percent and about 3.6 percent by the first carbonator 60, and is then passed to the second carbonator 70 where the soda from the first carbonator 60 is further carbonated up to about 3.6 percent to about 4.2 percent. Thus, the system is capable of supplying soda with a carbonation level (by weight percent) that meets or exceeds commercial standards for post-mixed beverages.

The system further includes a plurality of gas regulators 210, 220, 230; a pair of pneumatic water booster pumps 80, 100; a plurality of carbonated beverage flavorant supply pumps 140; a plurality of non-carbonated beverage supply pumps 160; a plurality of gas conduits 300, 310, 320, 330, 340, 350, 360; a plurality of flat water conduits 400, 410, 420, 430, 440; a plurality of soda conduits 500, 510, 520; and a plurality of flavorant conduits 600, 610. Flat water, soda, flavorants for carbonated beverages, and non-carbonated beverages are supplied to a bar gun 120 for dispensing in a manner known in the art.

Compressed carbon dioxide ($CO_2$) gas is supplied to the system 10 from a $CO_2$ cylinder 30 through a $CO_2$ supply valve 35. In a preferred embodiment, the cylinder 30 is a disposable high-pressure cylinder 30 capable of supplying compressed $CO_2$ at a pressure up to at least about 1800 psi The supply valve permits and controls entry of $CO_2$ into the system 10 from the cylinder. A primary regulator 200 regulates the pressure of the $CO_2$ entering the system 10 from the cylinder 30 to about 120 psi. Detailed descriptions of embodiments of the cylinder 30 and supply valve 35 are discussed below $CO_2$ from the cylinder 30 passes through three distinct conduit networks within the system 10. $CO_2$ is delivered through gas conduit 300 at a pressure of about 120 psi to a first regulator 230 and a second regulator 220. The first gas regulator 230 supplies $CO_2$ at about 83 psi to the second water booster pump 100 via gas conduit 310. The second gas regulator 220 supplies $CO_2$ to the first carbonator 60 and the second carbonator 70 at about 100 psi through gas conduit 320. The second gas regulator 220 also supplies gas at about 100 psi to the third regulator 210 through gas conduit 330. The third gas regulator 210 regulates the supply of gas to the first water booster pump 80 via gas conduit 360, the non-carbonated beverage pumps 160 via gas conduits 350, and the carbonated beverage flavorant pumps 140 via gas conduits 340 at about 56 psi. The regulators preferably are adjustable in-line high pressure gas regulators such as those available from Ashby Industries.

The water booster pumps 80, 100 are pneumatic pumps powered by pressurized $CO_2$ gas. The water booster pumps 80, 100 pump flat water (uncarbonated) within the system 10 without electricity. The first and second water booster pumps 80, 100 may be FloJet® G Series pumps such as FloJet® Model G58 pumps, which are available from FloJet Corp. of Irvine, CA. Other suitable pneumatic pumps may also be used in system 10. The first water booster pump 80 draws flat water from the flat water supply 20 through water conduit 400 and pumps the flat water to and through the cold plate 50. The flat water supply 20 may be a disposable bag. The cold plate 50 is chilled to about 32 degrees Fahrenheit by ice residing in the ice tray 40. A drain 110 may be provided for draining melted ice from the ice tray 40 to a drain receptacle or bag 112. The flat water is chilled in the cold plate 50 to about 33 degrees Fahrenheit. A portion of the chilled water passes through conduit 420 and to a water pressure regulator 90. Preferably, a water pressure regulator 90 is provided to regulate the pressure of the chilled flat water passed to the second water booster pump 100 through water conduit 430 to about 30 psig(?). The second water booster pump 100 pumps the chilled flat water to the first carbonator 60 at about 100 psi. Another portion of the chilled flat water exiting the cold plate 40 is diverted to the beverage dispensing gun 120 via water conduit 425.

Chilled flat water is subjected to a first stage of carbonation in the first carbonator 60. The solubility of gaseous $CO_2$ in water is maximized when the water temperature is minimized and the pressure of the $CO_2$ gas to which the cold water is exposed is maximized. Because the flat water is introduced into the first carbonator 60 at a temperature of about 33 degrees Fahrenheit and the $CO_2$ gas is introduced into the first carbonator at a high pressure (about 100 psi), the carbonation of the flat water in the first carbonator is highly effective. In a preferred embodiment, the first carbonator 60 is capable of carbonating chilled flat water to between about 2.4 percent and about 3.6 percent. The pressure of the $CO_2$ gas that is introduced into the first carbonator 60 is limited by the pressure of the supplied flat water. If the gas pressure exceeds the water supply pressure, the flow of water into the carbonator 60 will be inhibited by the excessive gas pressure.

The partially carbonated soda produced by the first carbonator 60 passes to the second carbonator through soda conduit 500 at a pressure of about 100 psi. The second carbonator 70 further carbonates the partially carbonated soda to between about 3.6 percent and about 4.2 percent. Details of embodiments of the first and second carbonators 60, 70 are discussed below. The fully carbonated soda produced by the second carbonator 70 is delivered to the cold plate 50 through soda conduit 510. The fully carbonated soda is chilled to about 33 degrees Fahrenheit by the cold plate 50, and is passed to a soda dispensing gun 120 through conduit 520 for post-mixing with carbonated beverage flavorants in a manner known in the art.

The system 10 includes one or more carbonated beverage flavorant supplies 130. The carbonated beverage flavorant supplies 130 may be disposable bags containing flavored syrups for soft drinks. The flavored syrup is drawn from each bag 130 through a syrup conduit 600 by a dedicated pneumatic pump 140. The pneumatic pumps 140 may be FloJet® N5000 pumps, which are available from FloJet Corp. of Irvine, California, though other suitable pneumatic pumps may also be used. The pumps 140 pump the syrups to a beverage dispensing gun 120 through syrup conduits 610.

The system 10 may also include supplies 150 of noncarbonated beverages or noncarbonated beverage concentrates or flavorants. For example, the supplies 150 may be disposable bags containing juices, juice concentrates, or fruit-flavored flavorants. When a supply 150 includes a concentrate or flavorant, the concentrate or flavorant is post-mixed with flat water at the dispensing gun 120. Each juice, juice concentrate, or other flavorant is drawn from its bag 150 by a dedicated pump 150 through a conduit 700, and is delivered to the dispensing gun 120 through a conduit 610.

The beverage dispensing gun 120 is of a type known in the art. For example, the beverage dispensing gun 120 may be an 8, 10, or 12-button Wunder-Bar™ bar gun produced by Automatic Bar Controls, Inc. of Vacaville, California. Other suitable beverage dispensers or bar guns may also be used.

Figure 2:
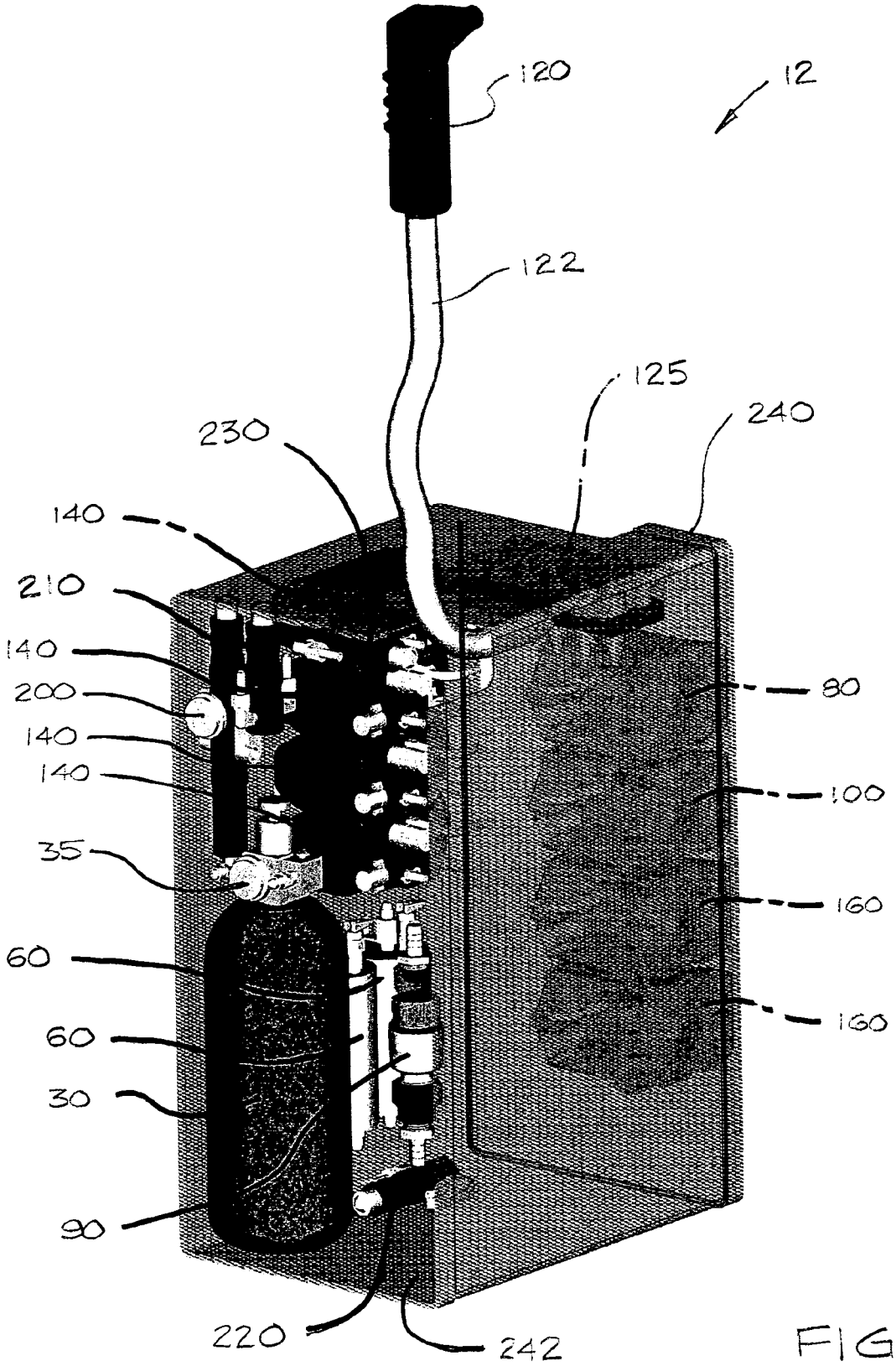
FIG. 2 is a perspective view showing the front of an embodiment of a beverage dispensing module for use in the beverage dispensing system of FIG. 1.
Figure 3:
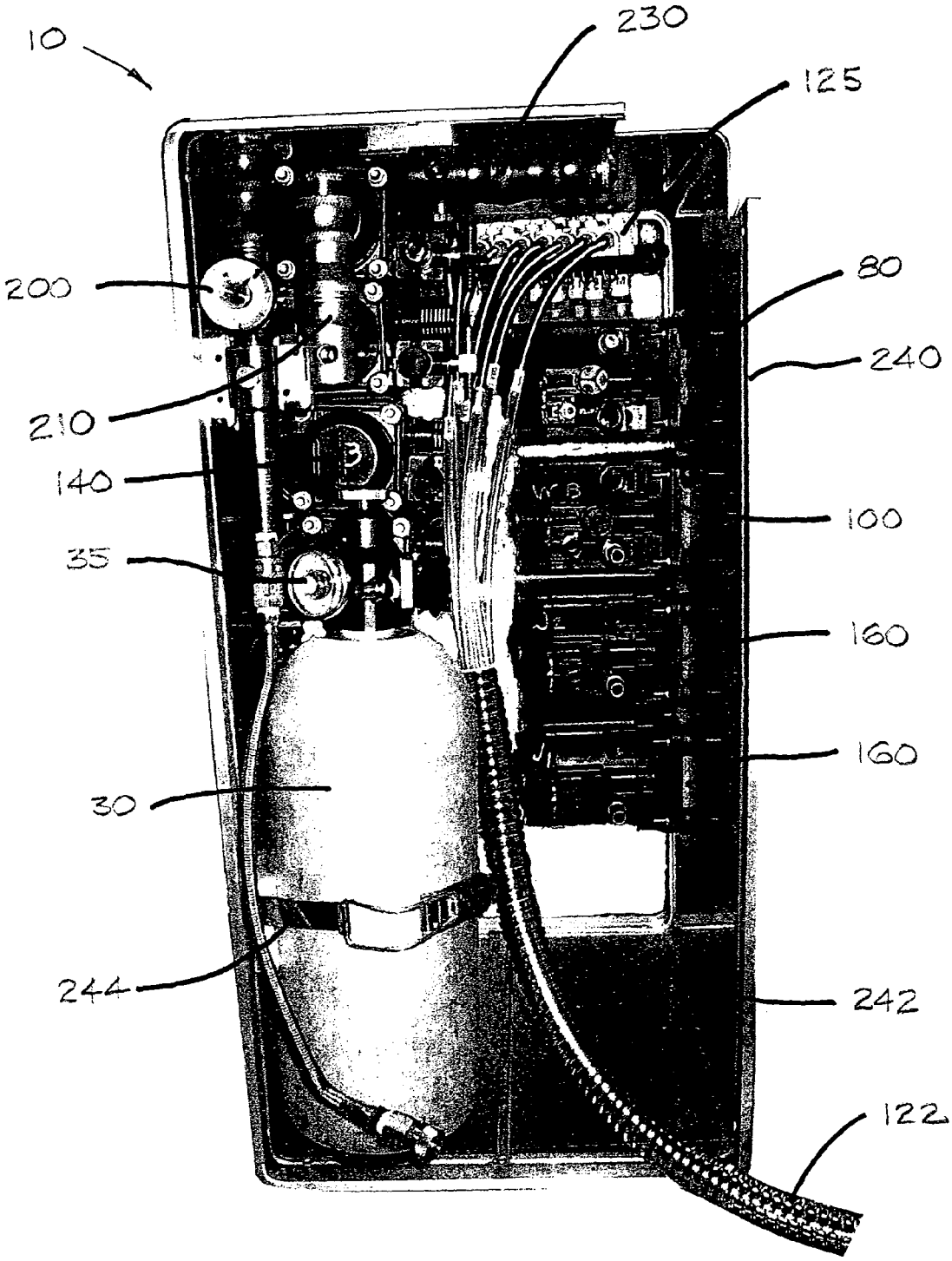
FIG. 3 is a front elevation view of the beverage dispensing module of FIG. 2.
Figure 4:
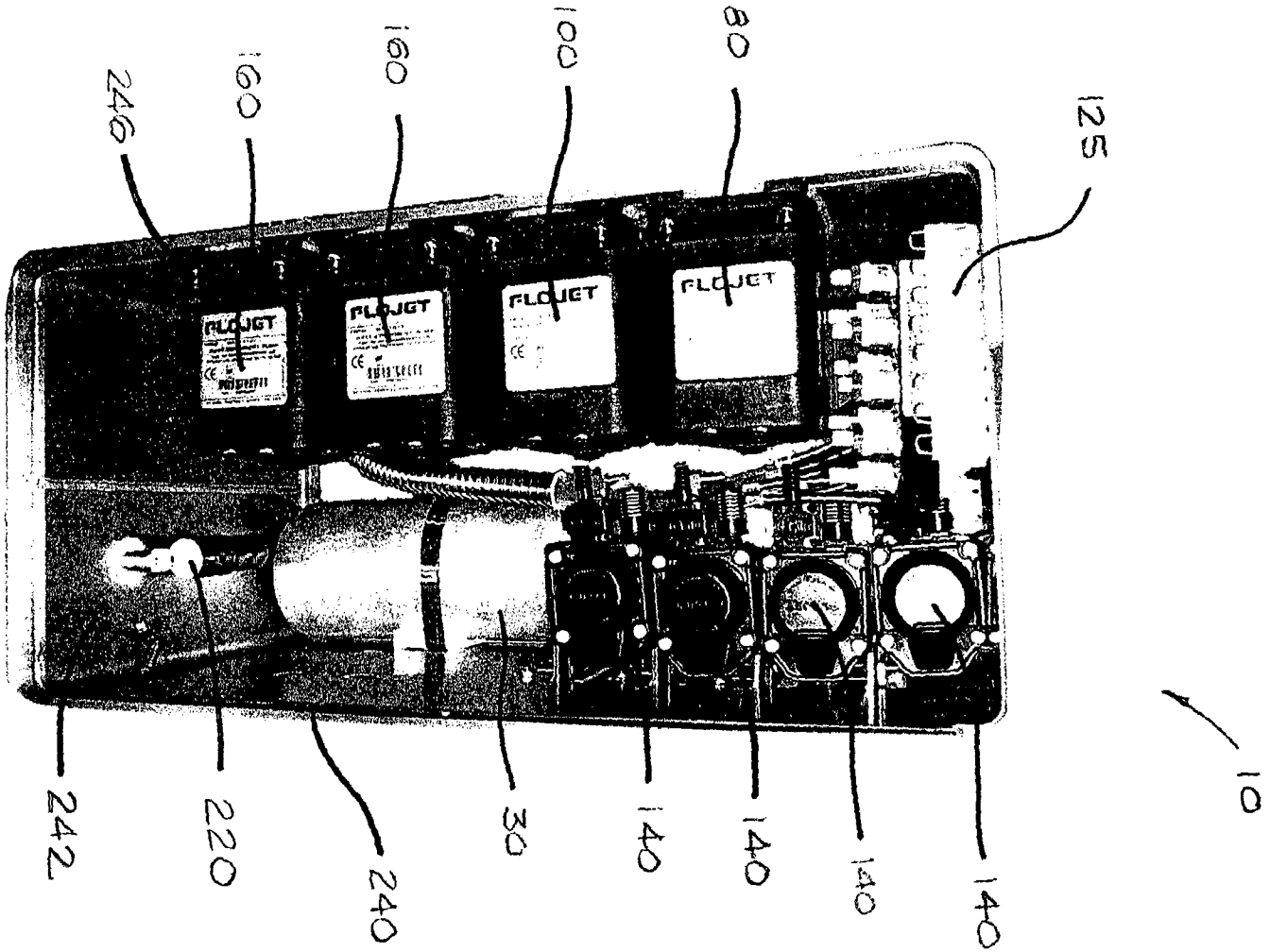
FIG. 4 is a rear elevation view of the beverage dispensing system of FIGS. 2 and 3.
Figure 5:
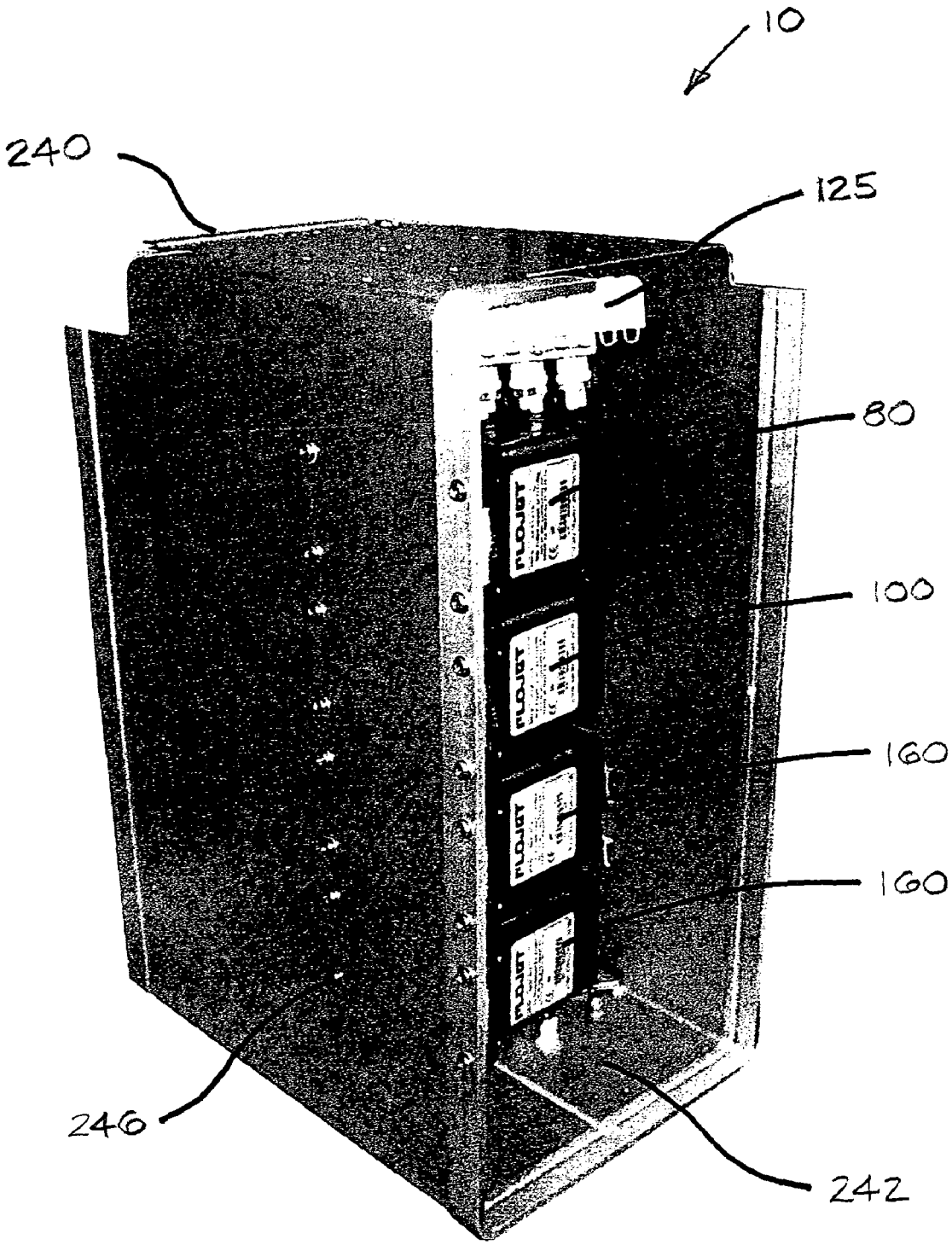
FIG. 5 is a perspective view showing the rear of the beverage dispensing module of FIGS. 2-4.

FIGS. 2-5 show one embodiment of a compact and portable beverage dispensing module 12 according to the invention. For clarity, the self-contained module 12 is shown in FIGS. 2-5 without the various conduits that are indicated in FIG. 1. The various water, soda, gas, and syrup conduits and their connections include suitably rated sanitary tubes and/or hoses and matching fittings like those known in the art. The module 12 includes a compact housing 240. Preferably, the housing is constructed of aluminum. Various components of the module 12 are contained within the housing 240. As shown in FIGS. 2-4, the high-pressure carbon dioxide cylinder 30 is positioned on the floor of the interior compartment 242 of the housing 240. As shown in FIGS. 2 and 3, the supply valve 35 is mounted on the neck of the cylinder 30. The primary gas regulator 200, the first gas regulator 230, the second gas regulator 220, and the third gas regulator 210 are also mounted in the housing 240. As best seen in FIGS. 4 and 5, the various pneumatic pumps 80, 100, 140, and 160 are mounted on the sidewalls of the housing 240 by suitable fasteners as best seen in FIGS. 4 and 5. A beverage-dispensing manifold 125 is mounted on the roof of the housing, and distributes water, soda, syrup, and/or juice to the bar gun 120 through a dispensing conduit 122.

Figure 6:
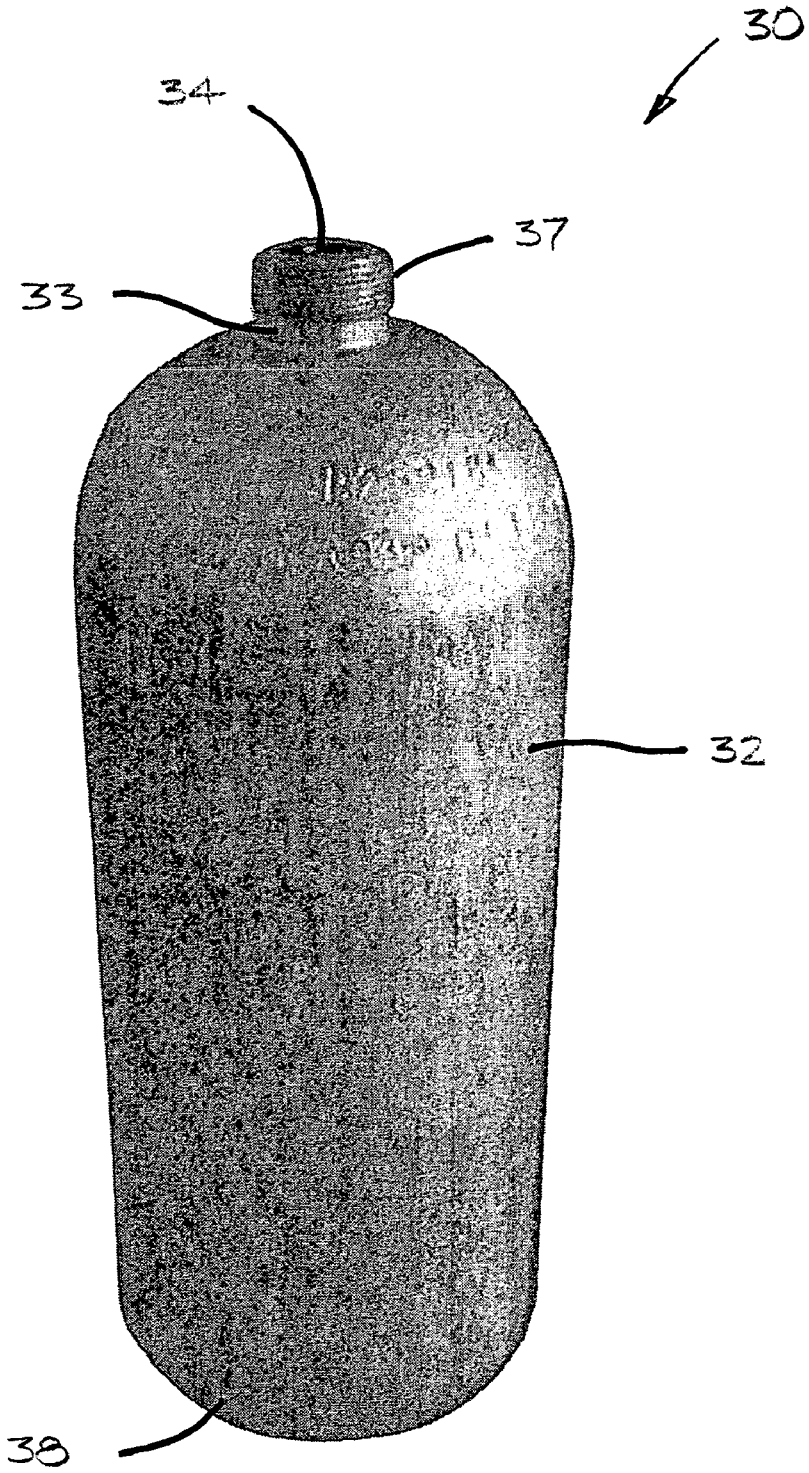
FIG. 6 is a perspective view of a high-pressure carbon-dioxide cylinder for use in the beverage dispensing module shown in FIGS. 2-5.
Figure 7:
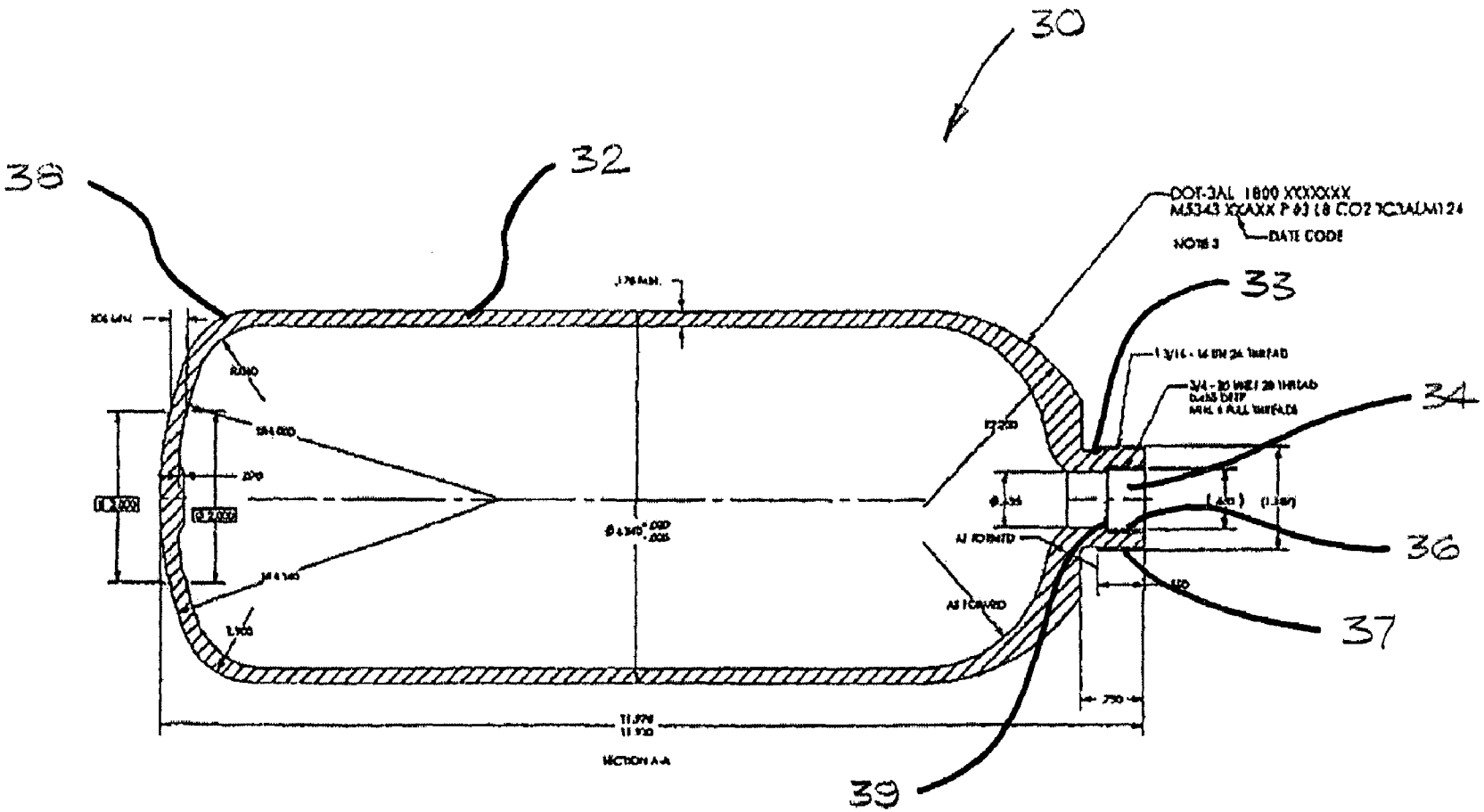
FIG. 7 is a cross-sectional view of the high-pressure carbon dioxide cylinder of FIG. 6.
Figure 8:
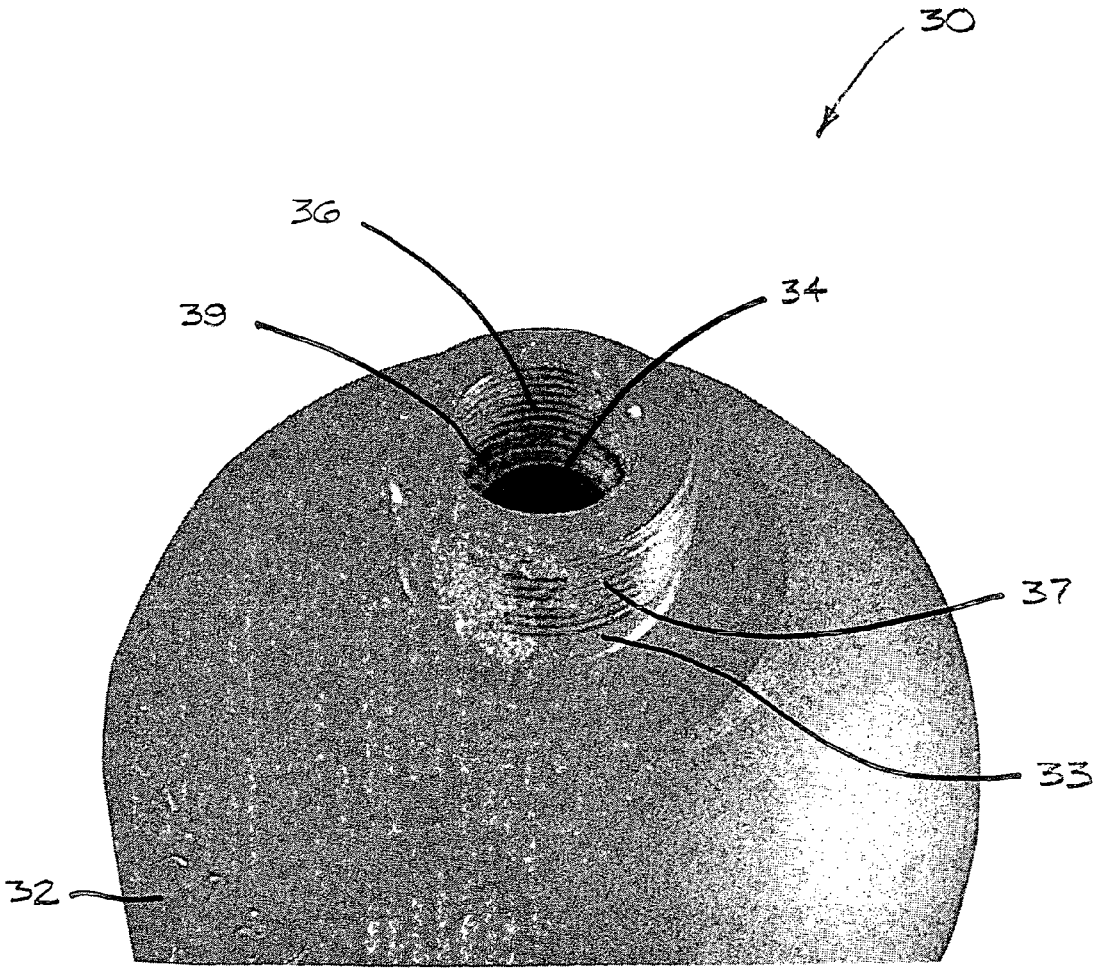
FIG. 8 is a detailed perspective view of the neck end of the cylinder shown in FIGS. 6 and 7.

FIGS. 6-8 show a disposable, compact high-pressure gas cylinder 30 suitable for use in the beverage dispensing system 10 and the beverage dispensing module 12 is shown in FIGS. 6-8. The cylinder 30 includes a bottom 38, a cylinder wall 32, a neck 33, and a throat 34. The neck 33 includes external threads 37 for connecting the neck to the supply valve 35. As shown in FIGS. 7 and 8, the throat 34 includes internal threads 36, and a flat-bottomed counterbore 39. The cylinder 30 preferably is seamless, and is constructed of a suitable grade of aluminum, such as 6061-T6 aluminum. In a preferred embodiment, the cylinder 30 is a DOT-3AL cylinder that is designed, constructed, and tested in accordance the requirements of the U.S. Code of Federal Regulations, Title 49, Part 178, Subpart C, Section 46 (37 CFR 178.46), entitled "Specification 3AL seamless aluminum cylinders". Accordingly, a preferred aluminum cylinder 30 is produced by the backward extrusion method. In addition, the minimum cylinder wall thickness is such that the wall stress at a minimum specified test pressure does not exceed eighty percent of the minimum yield strength of the cylinder material, and does not exceed sixty-seven percent of the minimum ultimate tensile strength of the material. Preferably, the cylinder 30 has a minimum service pressure of 1800 psi and a minimum test pressure of 3000 psi. In a preferred embodiment, the cylinder has a nominal wall thickness of about 0.18 inches, has a nominal outside diameter of about 4.34 inches, and has a total length of about 12 inches. The cylinder 30 is disposable per DOT-39, and is not designed or intended to be recharged or reused. The DOT-39 requirements for non-reusable (non-refillable) gas cylinders are identified in the U.S. Code of Federal Regulations, Title 49, Part 178, Subpart C, Section 65 (37 CFR 178.65). In a preferred embodiment, the cylinder 30 has a water capacity between about 67.4 fluid ounces and about 69 fluid ounces. The cylinder has a preferred maximum carbon dioxide fill weight of about 3.0 pounds (or about 1361 grams).

Figure 9:
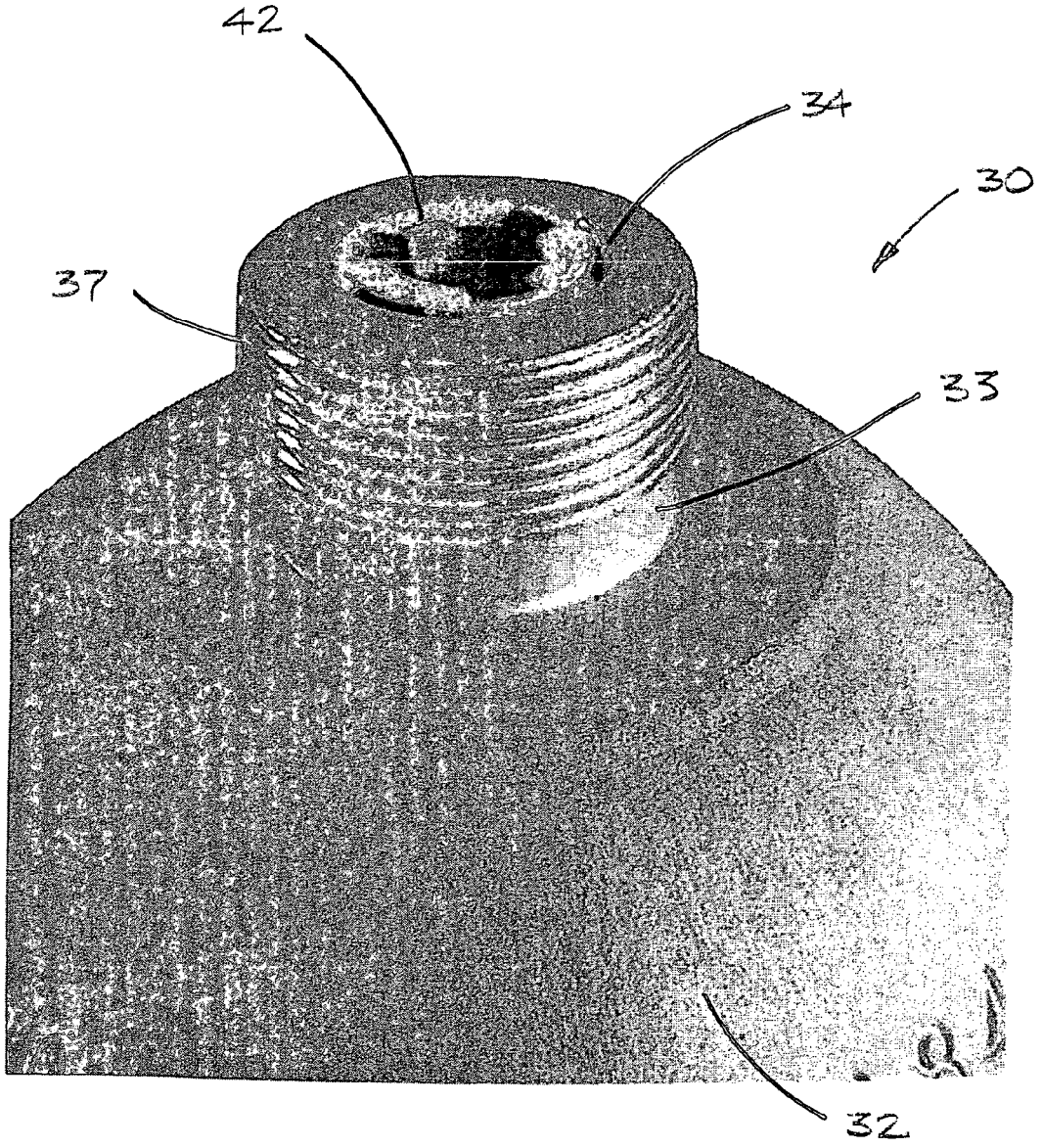
FIG. 9 is a detailed perspective view of the neck end of the cylinder shown in FIGS. 6-8 with a piercable plug in the throat of the cylinder.
Figure 10A:
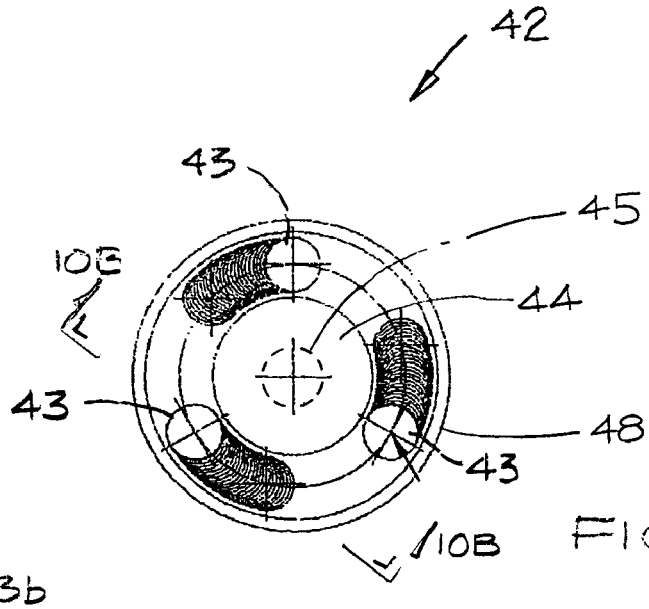
FIG. 10A is a top plan view of an embodiment of a piercable plug for plugging the throat of the cylinder shown in FIG. 9.
Figure 10B:
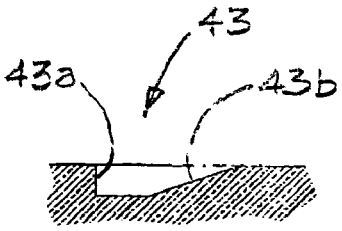
FIG. 10B is a partial cross-section of the pierceable plug as taken along line 10B-10B in FIG. 10A.
Figure 10C:
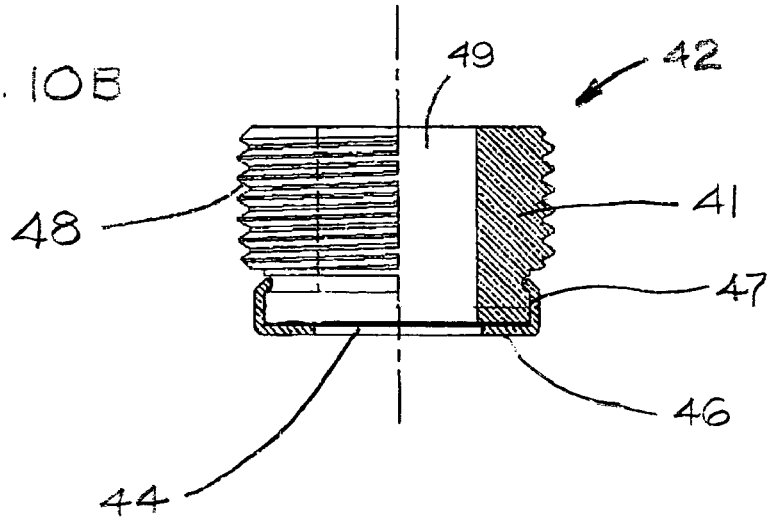
FIG. 10C is an elevation view of the piercable plug of FIG. 10A shown in partial cross-section.

As shown in FIG. 9, the throat 34 of cylinder 30 receives a piercable plug 42. As shown in FIGS. 10A and 10C, a preferred embodiment of the piercable plug 42 includes a bushing 41 having a through bore 49, and external threads 48 for engagement with the internal threads 36 in the throat 34. The plug 42 has a flat bottom 46 that seats in the flat-bottomed counterbore 39 of the cylinder 30, as shown in FIG. 12A. As shown in FIGS. 10A and 10B, the plug 42 may include a plurality of spaced, one-way drive holes 43. As shown in FIG. 10B, each one-way drive hole 43 includes a vertical wall 43*a* and an opposed sloped wall 43*b*. To seat the plug 42 in the throat 34 of the cylinder 30, a suitable spanner wrench (not shown) can be engaged in the spaced drive holes 43 to screw the plug 42 into the throat 34. The spanner wrench can be used to apply circumferential forces to the vertical walls 43*a* of the holes 43 to apply a clockwise seating torque to the plug 42. Once the plug 42 is seated in the cylinder 30, the sloped walls 43*b* of the drive holes 43 prevent the wrench from being used to apply a counter-clockwise torque to the plug 42 to loosen or remove the plug 42 from the cylinder 30.

As shown in FIGS. 10A and 10B, a frangible membrane 44 is centered in the lower end of plug 42. The membrane 44 is captured on the end of the bushing 41 by a retainer 47 that is swaged on the end of the bushing as shown in FIG. 10C. The plug 42 is shown in FIG. 10A with the location of a pierced hole 45 in the membrane 44 drawn in dashed lines. When the membrane 44 is pierced, the pierced hole 45 permits compressed gas to pass through the membrane 44 and plug 42 and to exit the cylinder 30. The bushing 41 and retainer 47 preferably are constructed of brass. The frangible membrane 44 may be constructed of brass, gold, or any other material that has sufficient strength to retain a compressed gas in the cylinder 30, and is also piercable. The plug 42 is configured to seal the throat 34 of the cylinder 30 and to thereby seal pressurized carbon dioxide within the cylinder 30 until the membrane 44 is pierced. A suitable sealant or other seal may be used to form a pressure-resistant seal between the plug 42 and the throat 34 of the cylinder 30. Other types of high-pressure plugs also may be used as long as the plugs are capable of containing high pressure gas within the cylinder and include a pierceable membrane 44.

Figure 11:
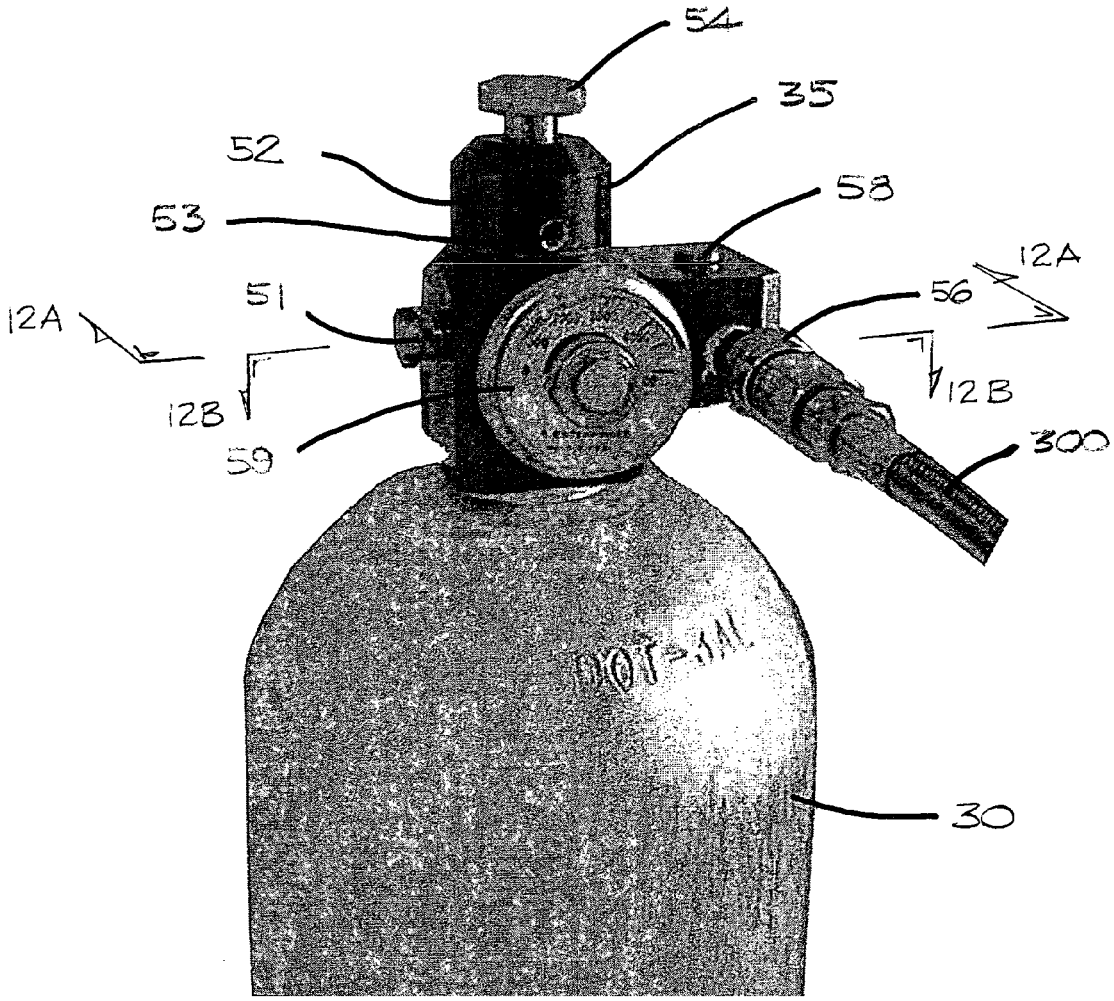
FIG. 11 is a perspective view of the cylinder shown in FIGS. 6-10 with a head valve installed on the neck of the cylinder.
Figure 12B:
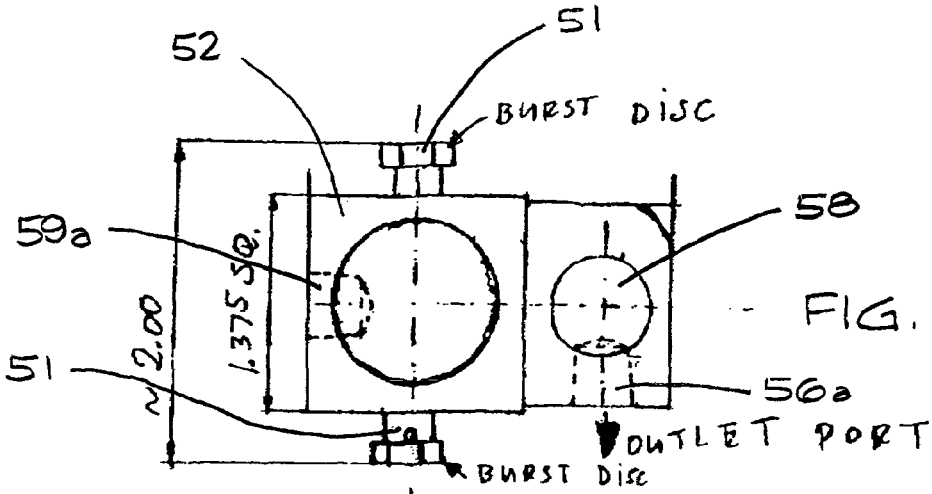
FIG. 12B is a cross-sectional view of the head valve taken along line 12B-12B in FIG. 11.
Figure 12A:
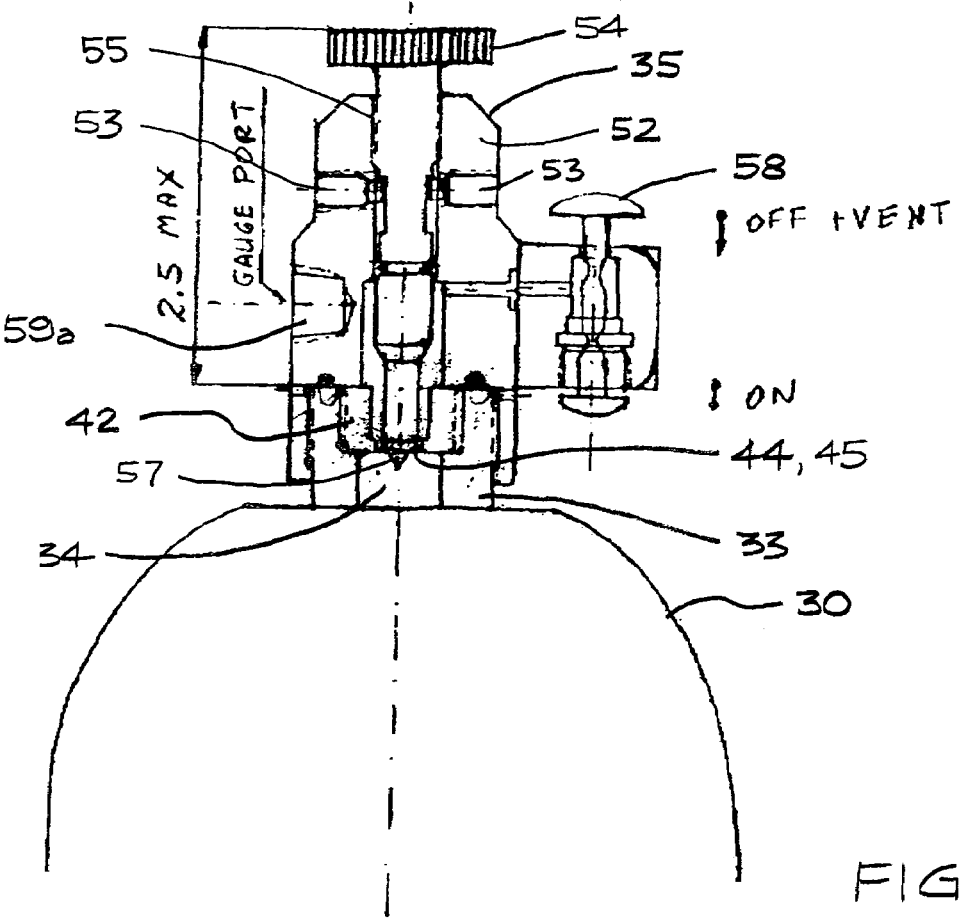
FIG. 12A is a cross-sectional view of the head valve taken along line 12A-12A in FIG. 11.
Figure 13:
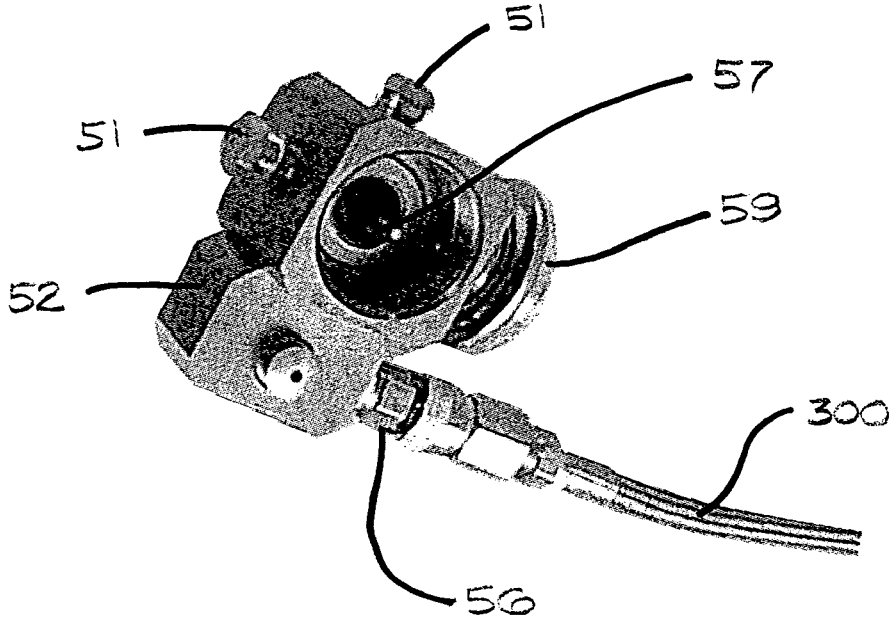
FIG. 13 is a bottom perspective view of the head valve shown in FIGS. 11-12B.

FIGS. 11-13 show an embodiment of a supply valve 35. In FIGS. 11 and 12A, the supply valve 35 is threaded onto the neck 33 of the cylinder 30. The supply valve 35 preferably includes a one-piece body 52, a valve stem 54, an on-off actuator or plunger 58 that controls the exit of gas through an outlet port 56*a*, and outlet fitting 56. The supply valve 35 also includes a pair of overpressure rupture discs 51 and a pressure gauge 59 for indicating the pressure of gas in the cylinder 30. As shown in FIG. 12A, the valve stem 54 includes a pointed tip 57. The stem 54 is threaded 55 in the valve body 52 such that the stem 54 can be inserted into and withdrawn from the throat 34 of the cylinder by rotating the stem 54. To pierce the membrane 44 of the plug 42 and permit compressed gas to exit the cylinder 30, the stem 54 is rotated and advanced into the throat 34 of cylinder 30 until the pointed tip 57 of the stem 54 pierces the membrane 44 and forms an opening 45. The stem 34 is then retracted from the throat 34 to permit gas to exit the cylinder 30 through the opening 45 and enter the supply valve 35 through the pierced opening 45. When the plunger 58 is in a raised position, the outlet port 56*a* is closed, and gas is prevented from exiting the valve 35. When the plunger 28 is lowered, an exit path is opened and gas is permitted to exit the valve through outlet port 56*a*. The high pressure carbon dioxide from the cylinder 30 is then free to pass through a gas conduit 300 to the first and second gas regulators 230, 220 as described above. One or more set screws 53 may be provided for selectively locking the stem 54 in a raised, non-piercing position to prevent inadvertent piercing of the membrane 44 by the pointed tip 57.

Figure 14:
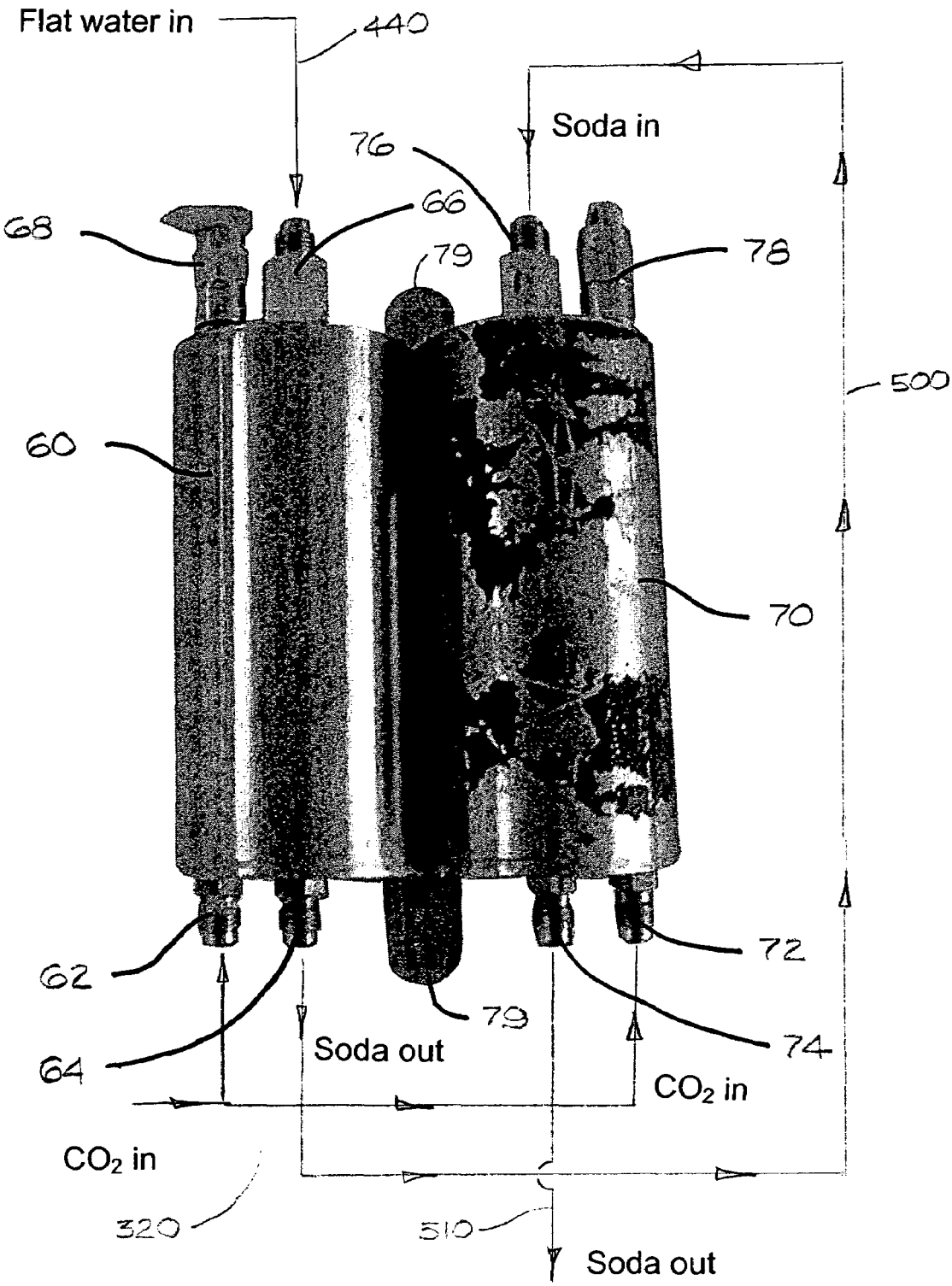
FIG. 14 is a perspective view of a two-stage motorless carbonating unit for use in the system of FIG. 1 and the beverage dispensing module of FIGS. 2-5.

FIG. 14 shows one embodiment of the first and second motorless carbonators 60, 70. Each carbonator 60, 70 includes a flat water inlet 66, 76, a carbon dioxide inlet 62, 72, a soda outlet 64, 74, and a pressure relief valve 68, 78. The first and second carbonators 60, 70 may be connected together, by one or more brackets 79, for example As indicated by the arrows in FIG. 14, chilled flat water enters the first carbonator 60 through water conduit 440 and water inlet 66. Preferably, the chilled flat water is supplied to the carbonator 60 at about 100 psi and about 33 degrees F. Carbon dioxide enters the carbonator 60 through gas inlet 62 from gas conduit 320 at about 100 psi. In the carbonator 60, a portion of the carbon dioxide gas is caused to dissolve in the chilled water, thereby producing partially carbonated soda with a $CO_2$ content of about 2.4 to 3.6 percent. In one embodiment, the first carbonator 60 is capable of producing about 1.5 fluid ounces of partially carbonated soda per second.

The partially carbonated soda then passes from the first carbonator 60 through outlet 64 and soda conduit 500, and enters the second carbonator 70 through inlet 76 at about 100 psi. Carbon dioxide enters the carbonator from gas conduit 320 at about 100 psi through gas inlet 72, and is caused to partially dissolve in the partially carbonated soda until carbonation reaches between about 3.6 and 4.2 percent. In one embodiment, the second carbonator 70 is capable of producing about 1.5 fluid ounces of fully carbonated soda per second. The fully carbonated water exits the second carbonator 70 through soda outlet 74, and is passed to the cold plate of system 10 through soda conduit 510. When supplied with partially carbonated soda having about 2.4-3.6 percent carbonation, the second carbonator is capable of producing fully carbonated soda carbonated to about 3.6-4.2 percent. The second stage of carbonation ensures that the fully carbonated soda meets acceptable commercial carbonation standards. Though the first and second carbonators 60, 70 are shown as separate components connected together by a bracket 79, persons of ordinary skill in the art will recognize that a single component having first and second carbonation chambers may also be used.

Figure 15:
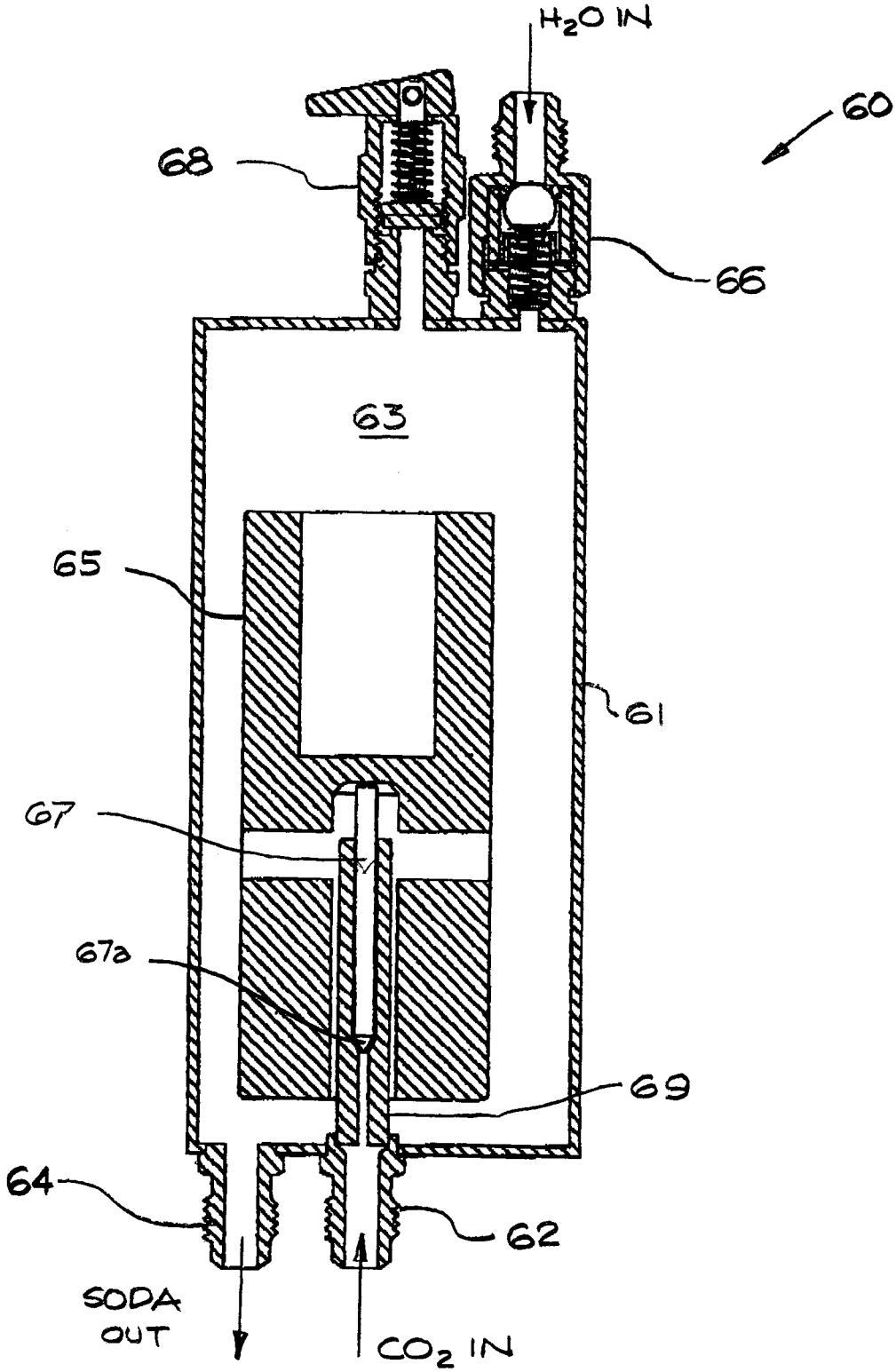
FIG. 15 is a cross-sectional view of one of the carbonators of the two-stage carbonating unit shown in FIG. 14.

FIG. 15 shows a cross section of one embodiment of a carbonation chamber or carbonator 60 for use in the two stage. An embodiment of the second carbonation chamber or carbonator 70 may be substantially the same as the embodiment of the first carbonation chamber or carbonator 60 shown in FIG. 15. The carbonator 60 includes an enclosure 61 defining an inner chamber 63. A tube 69 is disposed in the chamber 63 and is connected to the carbon dioxide inlet 62. A float 65 is disposed in the chamber 63 and includes a pin or needle 67 that is slidably engaged in the tube 69. In the configuration shown in FIG. 15, the float 65 and needle 67 are in a lowermost position in the enclosure 61. In this position, the nose 67*a* of the needle 67 is seated in the tube 69 such that carbon dioxide gas is prevented from entering the inner volume 63 through the carbon dioxide inlet 62. The float 65 has sufficient dry weight to hold the nose 67*a* of the needle 67 in a seated position in the tube 69 in opposition to the pressure of the carbon dioxide trying to enter the carbonator 60 through the gas inlet 62. The material of the float 65 also has a density that is sufficiently low to cause the float 65 to be buoyant in water. In a preferred arrangement, the enclosure 61, tube 69, and needle 67 are constructed of stainless steel, and the float 65 is constructed of a food-grade Teflon®.

In operation, as carbonated soda is drawn from the carbonator 60 through outlet 64, the weight of the float 65 causes the float 65 and needle 67 to fall to a closed position and to prevent pressurized gas from completely backfilling the inner chamber 63 of the carbonator 60. Flat water then enters the evacuated portion of chamber through water inlet 66. As the flat water backfills the inner chamber 63 and reaches a level in the enclosure 61 that is sufficient to cause the float 65 and needle 67 to rise in the chamber 63, carbon dioxide is permitted to enter the chamber 63 through tube 69. Once an equilibrium is reached in the chamber 63, water and gas both are prevented from entering the chamber 63. At the high pressure (about 100 psi) and low temperature (about 33 degrees F.) within the chamber 63, the carbon dioxide gas is caused to at least partially dissolve in the flat water to form soda. In the two-stage carbonator shown in FIG. 14, partially carbonated soda exits the first carbonator 60 through soda outlet 64 and passes to the second carbonator 70 through soda inlet 76 for further carbonation.

Figure 16:
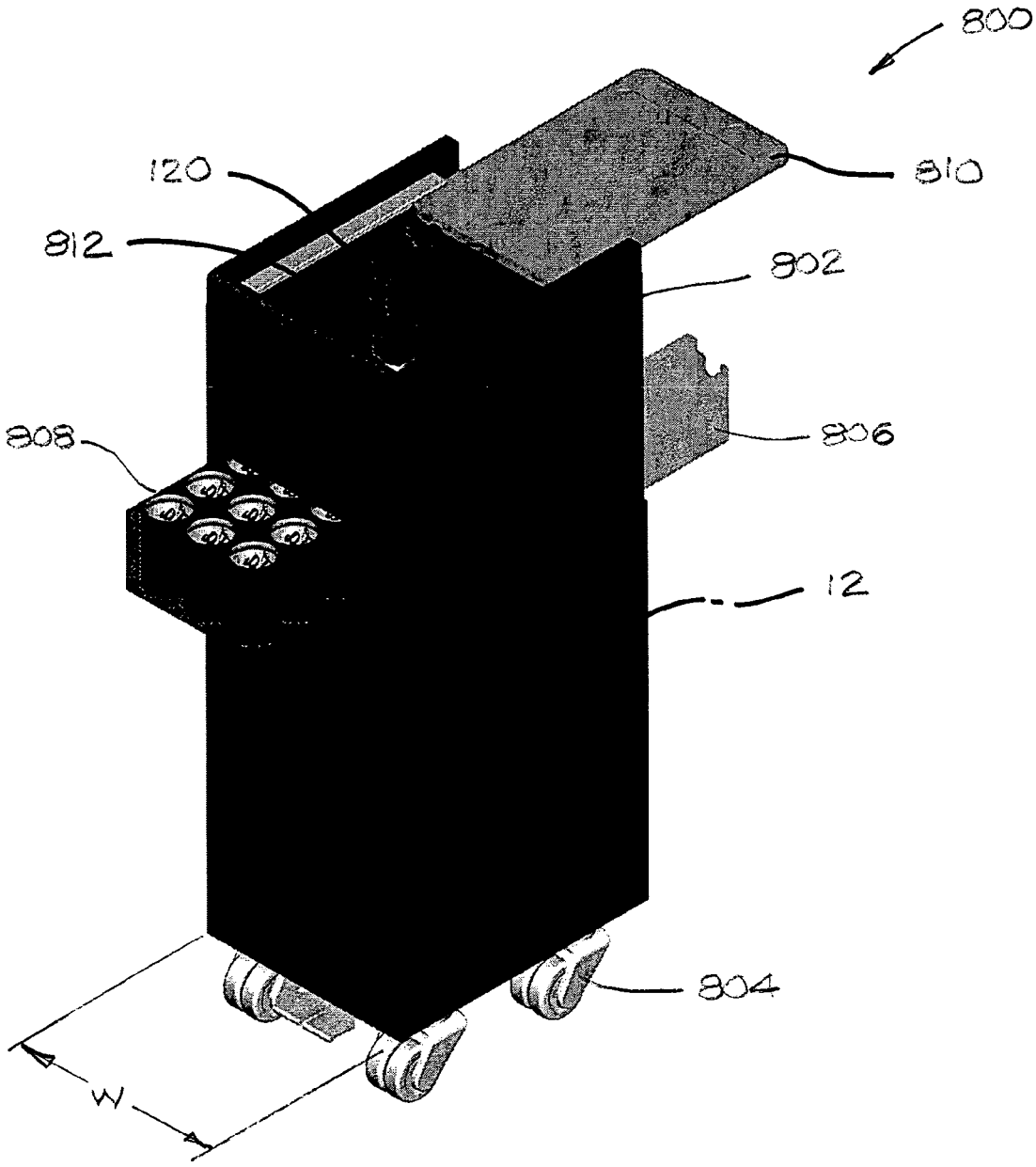
FIG. 16 is a perspective view of the front of an embodiment of a portable beverage dispensing cart according to the invention.
Figure 17:
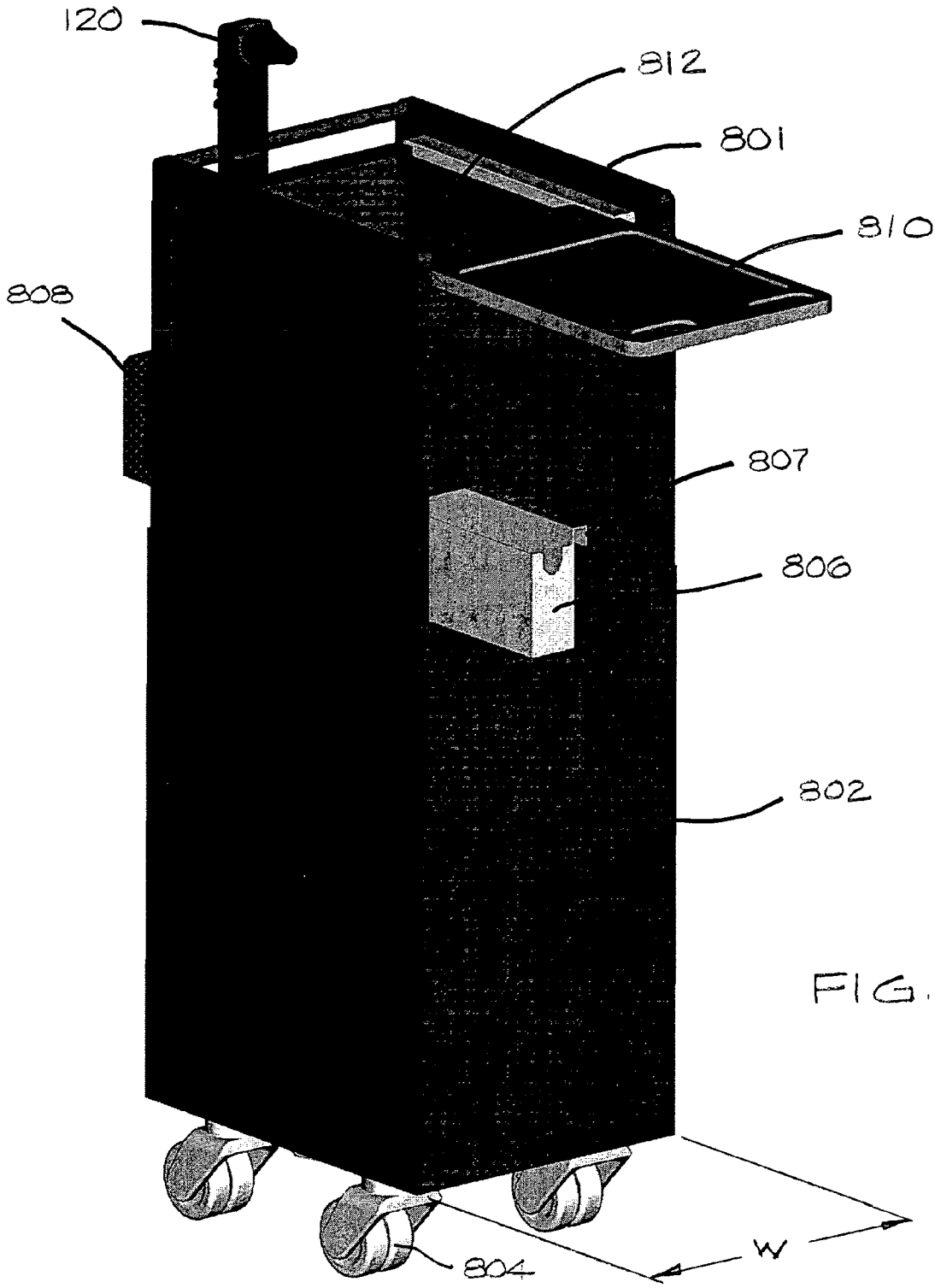
FIG. 17 is a perspective view of the rear of the beverage dispensing cart shown in FIG. 16.

FIGS. 16 and 17 show a portable beverage dispensing cart 800 that includes a beverage dispensing system 10 and beverage dispensing module 12 as described above. The cart 800 includes a housing 802, an ice chamber 812 with a movable cover 810, and a plurality of wheels or casters 804. The cart 800 may include a first supply drawer 808 and a second supply drawer 806. Preferably, one or both of the drawers 806 and 808 include a lockable top for securing alcoholic beverages or the like inside the drawers (not shown). In a preferred embodiment, the drawer 806 is removable from the housing 802, and includes a channel-shaped lip 807 that can be engaged on an edge 801 of the housing 802 to hang the drawer 806 at a convenient position on the cart 800. A beverage dispensing gun 120 is positioned in the ice chamber 812. Ice placed in the ice chamber rests atop and chills the cold plate 50 (see FIG. 1). The cold plate 50 forms the floor of the ice chamber 812 (not shown). A sink or basin may also be located inside the ice chamber for catching spills and the like (not shown) As shown in FIGS. 16 and 17, the cart 800 has a width "W". Preferably, the width "W" is sufficiently narrow to permit the cart 800 to pass down the aisles of at least most commercial airliners. In a preferred embodiment, the cart is about 10-11 inches wide. Preferably, the cart complies with all applicable airline industry standards for galley equipment.

Although only a few exemplary embodiments of this invention have been described in detail above, those of ordinary skill in the art will readily appreciate that many modifications are possible in the exemplary embodiments without materially departing from the novel teachings and advantages of this invention. Accordingly, all such modifications are intended to be included within the scope of the appended claims. In the claims, where a means-plus-function clause is recited, the clause is intended to cover the structures described herein as performing the recited function and not only structural equivalents, but also equivalent structures. Thus, although a nail and screw may not be structural equivalents in that a nail employs a cylindrical surface to secure wooden parts together, whereas a screw employs a helical surface, in the environment of fastening wooden parts, a nail and screw may be equivalent structures.

What is claimed is:

1. A portable beverage dispensing system comprising:

(a) a supply of flat water:

(b) a supply of pressurized gaseous carbon dioxide;

(c) a first motorless carbonator configured to receive a portion of the flat water and a portion of the carbon dioxide and to cause a portion of the carbon dioxide to dissolve in the flat water to produce partially carbonated soda;

(d) a second motorless carbonator configured to receive a portion of the partially carbonated soda and a portion of the carbon dioxide and to cause a portion of the carbon dioxide to dissolve in the partially carbonated soda and to produce fully carbonated soda;

(e) a dispenser for selectively dispensing the fully carbonated soda; and (f) a flavored syrup supply and at least one pneumatic pump powered by the pressurized carbon dioxide, the pump being configured to cause flavored syrup to pass from the syrup supply to the dispenser, and wherein the dispenser mixes syrup with the fully carbonated soda in a desired proportion.

2. A portable beverage dispensing system according to claim 1 wherein the flat water is supplied to the first motorless carbonator at about 90 psi to about 110 psi.

3. A portable beverage dispensing system according to claim 2 wherein the flat water is supplied to the first motorless carbonator at about 100 psi.

4. A portable beverage dispensing system according to claim 1 wherein the carbon dioxide is supplied to the first and second motorless carbonators at about 90 psi to about 110 psi.

5. A portable beverage dispensing system according to claim 4 wherein the carbon dioxide is supplied to the first and second motorless carbonators at about 100 psi.

6. A portable beverage dispensing system according to claim 1 wherein the partially carbonated soda has about 2.4 percent to about 3.6 percent carbonation.

7. A portable beverage dispensing system according to claim 6 wherein the fully carbonated soda has about 3.6 percent to about 4.2 percent carbonation.

8. A portable beverage dispensing system according to claim 1 and further including an ice-chilled cold plate, and wherein the portion of flat water received by the first carbonator is chilled by the cold plate before the flat water is received by the first carbonator.

9. A portable beverage dispensing system according to claim 8 wherein the portion of flat water received by the first carbonator is chilled by the cold plate to a temperature less than about 40 degrees Fahrenheit.

10. A portable beverage dispensing system according to claim 8 wherein the portion of flat water received by the first carbonator is chilled by the cold plate to a temperature of about 33 degrees Fahrenheit.

11. A portable beverage dispensing system according to claim 1 wherein the supply of pressurized gaseous carbon dioxide comprises a high pressure gas cylinder, and the cylinder conforms to the requirements of 49 CFR 178.46.

12. A portable beverage dispensing system according to claim 1 wherein the supply of pressurized gaseous carbon dioxide comprises a high pressure gas cylinder, and the cylinder has a liquid capacity of about 68 fluid ounces.

13. A portable beverage dispensing system according to claim 1, wherein the supply of pressurized gaseous carbon dioxide comprises a high pressure gas cylinder having a neck with a throat, and a plug inserted and retained within the throat and having a piercable membrane connected thereto, and further comprising a gas supply valve having a stem configured for selectively piercing the membrane.

14. A portable beverage dispensing system according to claim 1 and further comprising at least one pneumatic pump powered by the pressurized carbon dioxide, the pump being configured to cause flat water to pass from the water supply to the first carbonator.

15. A portable beverage dispensing system comprising:

(a) a supply of flat water;

(b) a high pressure cylinder containing pressurized carbon dioxide and including a neck having a throat and a selectively piercable membrane sealing the throat;

(b) at least one motorless carbonator configured to receive a portion of the flat water and a portion of the carbon dioxide and to cause a portion of the carbon dioxide to dissolve in the flat water to produce carbonated soda; (c) a dispenser for selectively dispensing carbonated soda and (d) a flavored syrup supply and at least one pneumatic pump powered by the pressurized carbon dioxide the pump being configured to cause flavored syrup to pass from the syrup supply to the dispenser, and wherein the dispenser mixes syrup with the carbonated soda in a desired proportion.

16. A portable beverage dispensing system according to claim 15 and comprising;

(a) a first motorless carbonator configured to receive a portion of the flat water and a portion of the carbon dioxide and to cause a portion of the carbon dioxide to dissolve in the flat water to produce partially carbonated soda;

(d) a second motorless carbonator configured to receive a portion of the partially carbonated soda and a portion of the carbon dioxide and to cause a portion of the carbon dioxide to dissolve in the partially carbonated soda and to produce fully carbonated soda.

17. A portable beverage dispensing system according to claim 15 wherein the flat water is supplied to the carbonator at about 90 psi to about 110 psi.

18. A portable beverage dispensing system according to claim 17 wherein the flat water is supplied to the first motorless carbonator at about 100 psi.

19. A portable beverage dispensing system according to claim 15 wherein the carbon dioxide is supplied to the carbonator at about 90 psi to about 110 psi.

20. A portable beverage dispensing system according to claim 19 wherein the carbon dioxide is supplied to the carbonator at about 100 psi.

21. A portable beverage dispensing system according to claim 15 wherein the carbonated soda has about 2.4 percent to about 4.2 percent carbonation.

22. A portable beverage dispensing system according to claim 15 and further including an ice-chilled cold plate, and wherein the portion of flat water received by the carbonator is chilled by the cold plate before the flat water is received by the carbonator.

23. A portable beverage dispensing system according to claim 22 wherein the portion of flat water received by the carbonator is chilled by the cold plate to a temperature less than about 40 degrees Fahrenheit.

24. A portable beverage dispensing system according to claim 22 wherein the portion of flat water received by the carbonator is chilled by the cold plate to a temperature of about 33 degrees Fahrenheit.

25. A portable beverage dispensing system according to claim 15 wherein the membrane is configured to resist rupture at pressures less than or equal to about 1800 psi.

26. A portable beverage dispensing system according to claim 15 wherein the cylinder conforms to the requirements of 49 CFR 178.46.

27. A portable beverage dispensing system according to claim 15 wherein the cylinder has a liquid capacity of about 68 fluid ounces.

28. A portable beverage dispensing system according to claim 15 and further comprising a gas supply valve having a stem configured for selectively piercing the membrane.

29. A portable beverage dispensing system according to claim 15 and further comprising at least one pneumatic pump powered by the pressurized carbon dioxide, the pump being configured to cause flat water to pass from the water supply to the carbonator.

30. A portable beverage dispensing module, the module comprising:

(a) a housing;

(b) a supply of pressurized gaseous carbon dioxide (c) a first motorless carbonator in the housing, the first carbonator being configured to receive flat water from a flat water supply and to receive a portion of the carbon dioxide, and to cause a portion of the carbon dioxide to dissolve in the flat water to produce partially carbonated soda;

(d) a second motorless carbonator in the housing, the second carbonator being configured to receive the partially carbonated soda and a portion of the carbon dioxide and to cause a portion of the carbon dioxide to dissolve in the partially carbonated soda and to produce fully carbonated soda;

(e) a dispenser for selectively dispensing the fully carbonated soda; and (d) at least one pneumatic pump powered by the pressurized carbon dioxide, the pump being configured to cause flavored syrup to pass from a syrup supply to the dispenser, and wherein the dispenser mixes syrup with the fully carbonated soda in a desired proportion.

31. A portable beverage dispensing module according to claim 30 wherein the carbon dioxide is supplied to the first and second motorless carbonators at about 90 psi to about 110 psi.

32. A portable beverage dispensing module according to claim 30 wherein the carbon dioxide is supplied to the first and second motorless carbonators at about 100 psi.

33. A portable beverage dispensing module according to claim 30 wherein the partially carbonated soda has about 2.4 percent to about 3.6 percent carbonation.

34. A portable beverage dispensing module according to claim 30 wherein the fully carbonated soda has about 3.6 percent to about 4.2 percent carbonation.

35. A portable beverage dispensing module according to claim 30 and further including an ice-chilled cold plate, and wherein the portion of flat water received by the first carbonator is chilled by the cold plate before the flat water is received by the first carbonator.

36. A portable beverage dispensing module according to claim 35 wherein the portion of flat water received by the first carbonator is chilled by the cold plate to a temperature less than about 40 degrees Fahrenheit.

37. A portable beverage dispensing module according to claim 35 wherein the portion of flat water received by the first carbonator is chilled by the cold plate to a temperature of about 33 degrees Fahrenheit.

38. A portable beverage dispensing module according to claim 30 wherein the membrane is configured to resist rupture at pressures less than or equal to about 1800 psi.

39. A portable beverage dispensing module according to claim 30 wherein the cylinder conforms to the requirements of 49 CFR 178.46.

40. A portable beverage dispensing system according to claim 30 wherein the cylinder has a liquid capacity of about 68 fluid ounces.

41. A portable beverage dispensing module according to claim 30 and further comprising a gas supply valve having a stem configured to selectively pierce the membrane.

42. A portable beverage dispensing module, the module comprising:

(a) a housing;

(b) a high pressure cylinder in the housing, the cylinder containing pressurized carbon dioxide and including a neck having a throat and a selectively piercable membrane sealing the throat;

(c) at least one motorless carbonator in the housing, the carbonator being configured to receive flat water from a flat water supply and a portion of the carbon dioxide and to cause a portion of the carbon dioxide to dissolve in the flat water to produce carbonated soda;

(e) a dispenser for selectively dispensing the carbonated soda, and;

(f) a flavored syrup supply and at least one pneumatic pump powered by the pressurized carbon dioxide, the pump being configured to cause flavored syrup to pass from the syrup supply to the dispenser and wherein the dispenser mixes syrup with the carbonated soda in a desired proportion.

43. A portable beverage dispensing module according to claim 42, the module comprising:

(a) a first motorless carbonator in the housing, the first carbonator being configured to receive flat water from a flat water supply and to receive a portion of the carbon dioxide, and to cause a portion of the carbon dioxide to dissolve in the flat water to produce partially carbonated soda; and (b) a second motorless carbonator in the housing, the second carbonator being configured to receive the partially carbonated soda and a portion of the carbon dioxide and to cause a portion of the carbon dioxide to dissolve in the partially carbonated soda and to produce fully carbonated soda; and (c) a dispenser for selectively dispensing the fully carbonated soda.

44. A portable beverage dispensing module according to claim 42 wherein the flat water is supplied to the carbonator at about 90 psi to about 110 psi.

45. A portable beverage dispensing module according to claim 42 wherein the flat water is supplied to the carbonator at about 100 psi.

46. A portable beverage dispensing module according to claim 42 wherein the carbon dioxide is supplied to the carbonator at about 90 psi to about 110 psi.

47. A portable beverage dispensing module according to claim 42 wherein the carbon dioxide is supplied to the carbonator at about 100 psi.

48. A portable beverage dispensing module according to claim 42 wherein the carbonated soda has about 2.4 percent to about 4.2 percent carbonation.

49. A portable beverage dispensing module according to claim 42 and further including an ice-chilled cold plate, and wherein the flat water received by the carbonator is chilled by the cold plate before the flat water is received by the carbonator.

50. A portable beverage dispensing module according to claim 42 wherein the flat water received by the carbonator is chilled by the cold plate to a temperature less than about 40 degrees Fahrenheit.

51. A portable beverage dispensing module according to claim 42 wherein the flat water received by the carbonator is chilled by the cold plate to a temperature of about 33 degrees Fahrenheit.

52. A portable beverage dispensing module according to claim 42 wherein the membrane is configured to resist rupture at pressures less than or equal to about 1800 psi.

53. A portable beverage dispensing module according to claim 42 wherein the cylinder conforms to the requirements of 49 CFR 178.46.

54. A portable beverage dispensing module according to claim 42 wherein the cylinder has a liquid capacity of about 68 fluid ounces.

55. A portable beverage dispensing module according to claim 42 and further comprising a gas supply valve having a stem configured for selectively piercing the membrane.

56. A portable beverage dispensing module according to claim 42 and further comprising at least one pneumatic pump powered by the pressurized carbon dioxide, the pump being configured to cause flat water to pass from a water supply to the carbonator.

* * * * *